US008978284B1

(12) United States Patent
Zusman

(10) Patent No.: US 8,978,284 B1
(45) Date of Patent: Mar. 17, 2015

(54) STOCK AND VIBRATION ISOLATOR FOR A SMALL ARMS WEAPON

(71) Applicant: Nisim Zusman, Ein Ayala (IL)

(72) Inventor: Nisim Zusman, Ein Ayala (IL)

( * ) Notice: Subject to any disclaimer, the term of this patent is extended or adjusted under 35 U.S.C. 154(b) by 0 days.

(21) Appl. No.: 14/154,129

(22) Filed: Jan. 13, 2014

Related U.S. Application Data

(63) Continuation-in-part of application No. 29/478,023, filed on Dec. 30, 2013.

(51) Int. Cl.
*F41A 17/00* (2006.01)
*F41C 23/06* (2006.01)
*F41C 23/22* (2006.01)

(52) U.S. Cl.
CPC ..... *F41C 23/06* (2013.01); *F41C 23/22* (2013.01)
USPC ..... 42/71.01; 42/73; 42/74; 42/1.06

(58) Field of Classification Search
USPC ..... 42/71.01, 73, 74, 1.06
See application file for complete search history.

(56) References Cited

U.S. PATENT DOCUMENTS

| | | | |
|---|---|---|---|
| 294,402 | A | 3/1884 | Onderdonk |
| 319,613 | A | 6/1885 | Onderdonk |
| 436,997 | A | 9/1890 | Quackenbush |
| 746,859 | A | 12/1903 | Marble |
| 922,173 | A | 5/1909 | Lovelace |
| 931,328 | A | 8/1909 | Marble |
| 961,511 | A | 6/1910 | Marble |
| 1,051,960 | A | 2/1913 | Kennedy |
| 1,086,490 | A | 2/1914 | Weathers |
| 1,156,293 | A | 10/1915 | Jorgenson |
| 1,174,840 | A | 3/1916 | Fisher |
| 1,485,456 | A | 3/1924 | Von Frommer |
| 1,734,852 | A | 11/1929 | Frampton et al. |
| 1,822,875 | A | 9/1931 | Ammann |
| 2,098,139 | A | 11/1937 | Foley et al. |
| 2,400,422 | A | 5/1946 | Jonhson, Jr. |
| 2,433,151 | A | 12/1947 | Parsons |
| 2,766,542 | A | 10/1956 | Harvey |
| 3,044,204 | A | 7/1962 | Zimmerman |
| 3,348,328 | A | 10/1967 | Roy |

(Continued)

FOREIGN PATENT DOCUMENTS

CN 300736403 1/2008

OTHER PUBLICATIONS

U.S. Appl. No. 61/360,487, filed Jun. 30, 2010, Zusman.

(Continued)

*Primary Examiner* — J Woodrow Eldred
(74) *Attorney, Agent, or Firm* — Law Office of Arthur M. Antonelli, PLLC

(57) ABSTRACT

A stock for a small arms weapon which may include a proximal end surface and a distal end surface, the distal end surface including a first opening extending toward the proximal end surface. The stock further may include a multi-lobe chamber connected to the first opening. The multi-lobe chamber may include a primary lobe for housing a receiver extension. The primary lobe may include a track for supporting a bottom surface of a receiver extension. The primary lobe further may include a first side lobe adjacent to the first wall, and a second side lobe adjacent to the second wall. A first insert may be disposed in the first side lobe and a second insert may be disposed in the second side lobe for isolating movement between the stock and a receiver extension disposed in the track.

19 Claims, 8 Drawing Sheets

(56) References Cited

U.S. PATENT DOCUMENTS

| | | | | |
|---|---|---|---|---|
| 3,618,248 | A | 11/1971 | Into et al. | |
| 3,618,249 | A | 11/1971 | Grandy | |
| 4,141,166 | A | 2/1979 | Schultz | |
| 4,271,623 | A | 6/1981 | Beretta | |
| 4,327,626 | A | 5/1982 | McQueen | |
| 4,512,101 | A | 4/1985 | Waterman, Jr. | |
| 4,551,937 | A | 11/1985 | Seehase | |
| 4,697,367 | A | 10/1987 | Brophy | |
| 4,735,007 | A | 4/1988 | Gal | |
| D324,557 | S | 3/1992 | Livingston | |
| 5,209,215 | A | 5/1993 | Morrison | |
| 5,225,613 | A | 7/1993 | Claridge | |
| 5,622,000 | A | 4/1997 | Marlowe | |
| 5,711,102 | A | 1/1998 | Plaster et al. | |
| D391,334 | S | 2/1998 | Plaster et al. | |
| 5,907,918 | A | 6/1999 | Langevin et al. | |
| 6,598,329 | B1 | 7/2003 | Alexander | |
| 6,598,330 | B2 | 7/2003 | Garrett et al. | |
| 6,651,371 | B2 | 11/2003 | Fitzpatrick et al. | |
| 6,779,289 | B2 | 8/2004 | Kay | |
| 6,829,855 | B2 | 12/2004 | Seifert | |
| 6,839,998 | B1 | 1/2005 | Armstrong | |
| 6,874,267 | B2 | 4/2005 | Fitzpatrick et al. | |
| 6,925,743 | B1 | 8/2005 | DiGiovanna | |
| 7,104,001 | B1 | 9/2006 | Digiovanna | |
| 7,131,228 | B2 | 11/2006 | Hochstrate et al. | |
| 7,152,355 | B2 | 12/2006 | Fitzpatrick et al. | |
| 7,162,822 | B1 | 1/2007 | Heayn et al. | |
| 7,337,573 | B1 | 3/2008 | Digiovanna | |
| 7,398,616 | B1 | 7/2008 | Weir | |
| 7,418,797 | B1 | 9/2008 | Crose | |
| 7,428,794 | B2 | 9/2008 | Oz | |
| D584,373 | S | 1/2009 | Young | |
| D589,578 | S | 3/2009 | Choma | |
| D600,308 | S | 9/2009 | Fitzpatrick et al. | |
| 7,587,852 | B1 | 9/2009 | Harms | |
| D603,013 | S | 10/2009 | Fitzpatrick et al. | |
| D604,794 | S | 11/2009 | Bentley | |
| 7,610,711 | B2 | 11/2009 | Oz | |
| 7,627,975 | B1 | 12/2009 | Hines | |
| 7,640,688 | B2 | 1/2010 | Oz | |
| 7,647,719 | B2 | 1/2010 | Fitzpatrick et al. | |
| 7,654,187 | B2 | 2/2010 | Hochstrate et al. | |
| 7,681,351 | B2 * | 3/2010 | Bucholtz et al. | 42/1.06 |
| D616,056 | S | 5/2010 | Bentley | |
| 7,743,544 | B2 | 6/2010 | Laney et al. | |
| D620,067 | S | 7/2010 | Saur | |
| 7,762,018 | B1 | 7/2010 | Fitzpatrick et al. | |
| 7,775,150 | B2 | 8/2010 | Hochstrate et al. | |
| 7,805,873 | B2 | 10/2010 | Bentley | |
| 7,810,270 | B2 | 10/2010 | Fitzpatrick et al. | |
| 7,823,313 | B2 | 11/2010 | Faifer | |
| 7,827,722 | B1 | 11/2010 | Davies | |
| D640,342 | S | 6/2011 | Fitzpatrick et al. | |
| 8,127,483 | B2 | 3/2012 | Kincel | |
| D661,366 | S | 6/2012 | Zusman | |
| 8,191,299 | B2 | 6/2012 | Faifer | |
| D668,311 | S | 10/2012 | Rogers et al. | |
| 8,341,868 | B2 | 1/2013 | Zusman | |
| D676,921 | S | 2/2013 | Fitzpatrick et al. | |
| 8,387,298 | B2 | 3/2013 | Kincel | |
| D683,808 | S | 6/2013 | Elkaim | |
| 8,555,541 | B2 | 10/2013 | Ingram | |
| 2003/0110675 | A1 | 6/2003 | Garrett et al. | |
| 2003/0196366 | A1 | 10/2003 | Beretta | |
| 2003/0200693 | A1 | 10/2003 | Seifert | |
| 2004/0016167 | A1 | 1/2004 | Fitzpatrick et al. | |
| 2005/0108915 | A1 | 5/2005 | Kincel | |
| 2005/0262752 | A1 | 12/2005 | Robinson et al. | |
| 2006/0096146 | A1 | 5/2006 | Fitzpatrick et al. | |
| 2006/0254414 | A1 | 11/2006 | Kuczynko et al. | |
| 2007/0261284 | A1 | 11/2007 | Keng | |
| 2008/0236016 | A1 | 10/2008 | Fitzpatrick et al. | |
| 2008/0236017 | A1 | 10/2008 | Fitzpatrick et al. | |
| 2008/0301994 | A1 | 12/2008 | Langevin et al. | |
| 2009/0139128 | A1 | 6/2009 | Fluhr | |
| 2009/0178325 | A1 | 7/2009 | Veilleux | |
| 2009/0241397 | A1 | 10/2009 | Fitzpatrick et al. | |
| 2009/0255161 | A1 | 10/2009 | Fitzpatrick et al. | |
| 2010/0115817 | A1 | 5/2010 | Faifer | |
| 2010/0180485 | A1 | 7/2010 | Cabahug et al. | |
| 2010/0192444 | A1 | 8/2010 | Cabahug et al. | |
| 2010/0192446 | A1 | 8/2010 | Darian | |
| 2010/0192447 | A1 | 8/2010 | Cabahug et al. | |
| 2010/0205846 | A1 | 8/2010 | Fitzpatrick et al. | |
| 2010/0229444 | A1 | 9/2010 | Faifer | |
| 2010/0251591 | A1 | 10/2010 | Burt et al. | |
| 2010/0275489 | A1 | 11/2010 | Cabahug et al. | |
| 2010/0300277 | A1 | 12/2010 | Hochstrate et al. | |
| 2011/0173863 | A1 | 7/2011 | Ingram | |
| 2011/0192067 | A1 | 8/2011 | Troy | |
| 2012/0000108 | A1 | 1/2012 | Zusman | |
| 2012/0042556 | A1 * | 2/2012 | Vesligaj | 42/75.03 |
| 2012/0079752 | A1 * | 4/2012 | Peterson et al. | 42/75.02 |
| 2012/0174455 | A1 | 7/2012 | Edelman et al. | |
| 2012/0174456 | A1 | 7/2012 | Depierro et al. | |
| 2012/0174457 | A1 | 7/2012 | Edelman | |
| 2012/0180353 | A1 * | 7/2012 | Holmberg | 42/1.06 |
| 2013/0180148 | A1 * | 7/2013 | Rogers et al. | 42/73 |

OTHER PUBLICATIONS

U.S. Appl. No. 61/417,950, filed Nov. 30, 2010, Zusman.

Locarno (International Designs) search results: Jan. 10, 2011, pp. 1-16.

* cited by examiner

STOCK AND VIBRATION ISOLATOR FOR A SMALL ARMS WEAPON

CROSS REFERENCE TO RELATED APPLICATIONS

This application is a continuation-in-part of application Ser. No. 29/478,023 filed Dec. 30, 2013, the disclosure of which is incorporated by reference herein in its entirety.

FIELD OF THE INVENTION

The invention relates to a stock for a small arms weapon. More particularly, the invention relates to a stock having a vibration isolator and a compartment which contains a capsule for storing spare parts.

BACKGROUND

Small arms may be defined as man-portable individual or crew-served weapon systems used against protected and unprotected personnel and light/unarmored vehicles. Man portable individual weapon systems such as an M4 carbine or AR-15 type firearm may be configured to mission requirements or individual preferences. For example, the stock of these weapons may be customized or adjusted for a user's size or preference. Adjustable stocks, however, may be connected loosely to these weapons, causing unwanted noise and movement. Additionally, these weapon systems may include laser pointers, fire control devices, night vision devices, optics, thermal weapon sights and other devices. Many of these accessories require one or more batteries to operate.

SUMMARY

Hence, the present invention is directed toward a stock of a small arms weapon having a vibration isolator. The present invention also is directed to a compartment in the stock that stores a sealed capsule which may be used to store a spare battery. The invention also is directed toward a method of preventing and isolating vibration in an adjustable stock for a small arms weapon.

One aspect of the present invention relates to a stock for a small arms weapon that may include a first member having a first longitudinal axis which comprises a distal end surface and a proximal end surface spaced from the distal end surface along the first longitudinal axis. The distal end surface may include a first opening extending toward the proximal end surface and a multi-lobe chamber connected to the first opening. The multi-lobe chamber may include a primary lobe for housing a receiver extension. The primary lobe may include a track for supporting a bottom surface of a receiver extension, a first wall for supporting a first side surface of a receiver extension, and a second wall for supporting a second side surface of a receiver extension. The multi-lobe chamber further may include a first side lobe adjacent to the first wall and a second side lobe adjacent to the second wall.

Moreover, the stock may include a first insert disposed in the first side lobe for preventing and isolating movement between the first side of the stock and a receiver extension disposed in the track. The first insert may include a first side leaf member. The first side leaf member may include a first side base for supporting a receiver extension disposed in the track and a first side resilient cantilever extending from the base for isolating movement between the first side of the stock and a receiver extension disposed in the track. The resilient cantilever may deform under pressure applied by a receiver extension disposed in the track opposite the first side leaf member to isolate movement between the first side of the stock and the receiver extension. A second insert may be disposed in the second side lobe for isolating movement between the second side of the stock and a receiver extension disposed in the track.

In another aspect, the first insert may comprise three first side leaf members. Additionally, the second insert may include a second side leaf member that includes a second side base, and a second side resilient cantilever extending from the second side base such that the second side resilient cantilever deforms under pressure applied by a receiver extension disposed in the track opposite the second side leaf member to isolate movement between the second side of the stock and the receiver extension.

In another aspect, a connecting member may join the first insert and the second insert to form a shim and a damper in the multi-lobe chamber for preventing and isolating movement between the stock and a receiver extension connected to the stock.

In another aspect, the first member may further include an exterior surface and a portion of the connecting member may form a part of the exterior surface.

In another aspect, the proximal end surface may include a fastener attachment site and a back plate secured to the proximal end surface. Additionally, the proximal end surface may include a second opening connected to the multi-lobe chamber. The back plate may cover the second opening.

In another aspect, the stock may include a second member connected to the first member. The second member may include a third end adjacent to the proximal end, and a fourth end spaced from the distal end. The second member may further include an interior compartment that is configured and dimensioned to house a cylindrical capsule. The cylindrical capsule may include a tubular member and a cap. The cap further may include a plug for sealing the tubular member. Additionally, the cap may include a cantilevered block, and the tubular member may include a projection such that the cap may be rotated with respect to the tubular member to interlock the projection and the cantilevered block.

In another aspect, the capsule further may include a rail and the interior compartment may include a channel and a catch disposed in the channel such that the rail and the catch may cooperate to lock the capsule in the interior compartment.

In another aspect, the stock may include a third member connected to the first and second members which may include a fifth end connected to the distal end of the first member, and a sixth end connected to the fourth end of the second member. The stock may further include a web disposed between the first member and the third member, as well as a spring loaded locking pin disposed in the web such that the locking pin is configured and dimensioned to interlock with a receiver extension disposed in the track to fix the stock to the receiver extension.

Also, the present invention relates to a method of assembling a stock for a small arms weapon that includes a vibration isolator. The method may include providing a small arms weapon stock that comprises a first member that includes a proximal end surface and a distal end surface. The distal end surface further may include a first opening extending toward the proximal end surface and a multi-lobe chamber connected to the first opening. The multi-lobe chamber may include a primary lobe for housing a receiver extension. The primary lobe may include a track for supporting a bottom surface of a receiver extension, a first wall for supporting a first side surface of a receiver extension, and a second wall for supporting a second side surface of a receiver extension. Additionally, the multi-lobe chamber may include a first side lobe adjacent to the first wall, and a second side lobe adjacent to the second wall. The method further may include inserting a vibration isolator into the first side lobe and the second side lobe from the proximal end of the stock for supporting a receiver extension disposed in the track and isolating movement between the stock and the receiver extension. Also, the method may include securing a back plate to the proximal end surface to enclose the vibration isolator in the stock.

DESCRIPTION OF THE DRAWINGS

In the accompanying drawings, which form a part of the specification and are to be read in conjunction therewith and in which like reference numerals (or designations) are used to indicate like parts in the various views.

DETAILED DESCRIPTION OF THE PREFERRED EMBODIMENT

Figure 1:
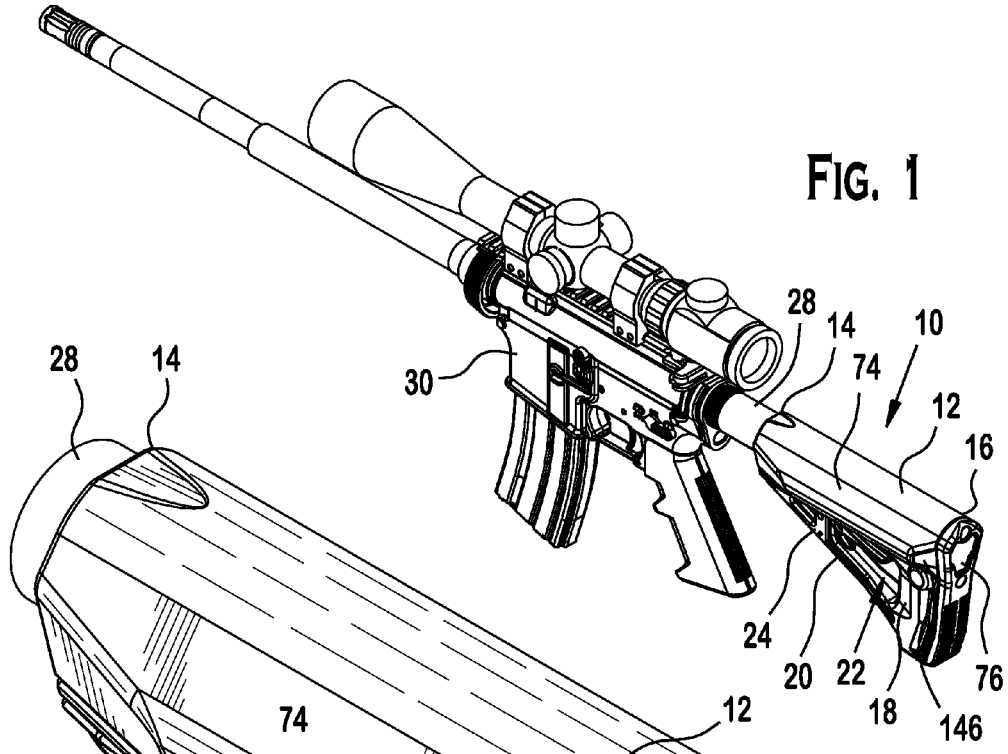
FIG. 1 is a perspective view of an M4 carbine with a gun stock according to the present invention.
Figure 2:
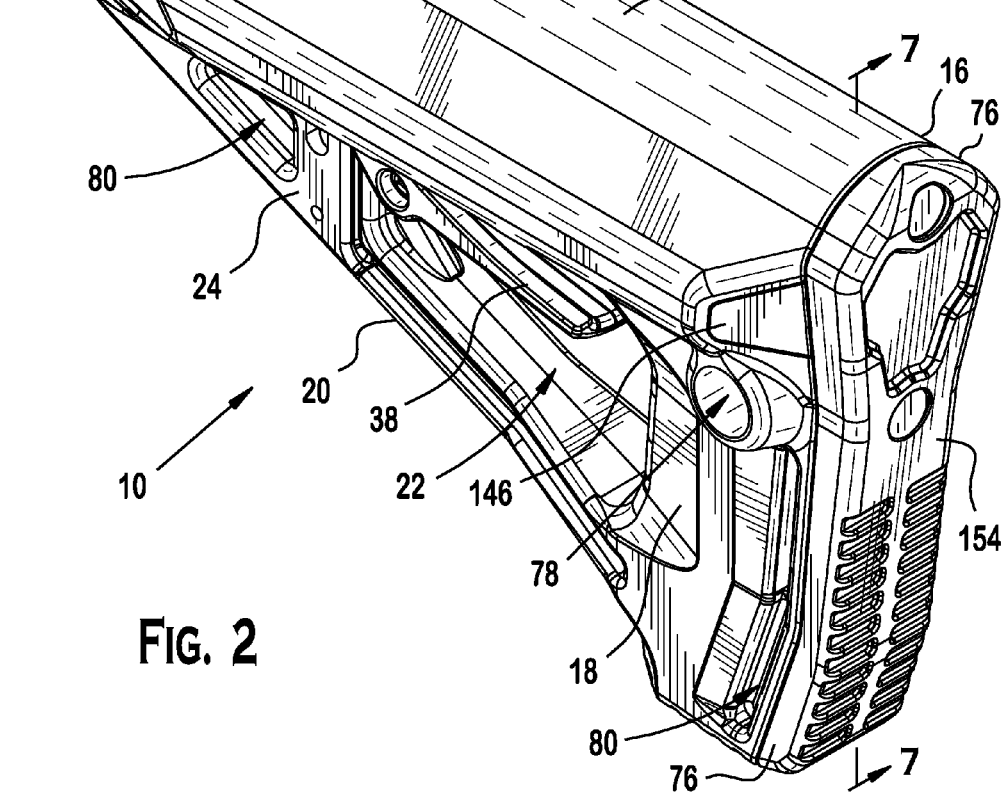
FIG. 2 is a perspective view of the stock of FIG. 1.
Figure 3:
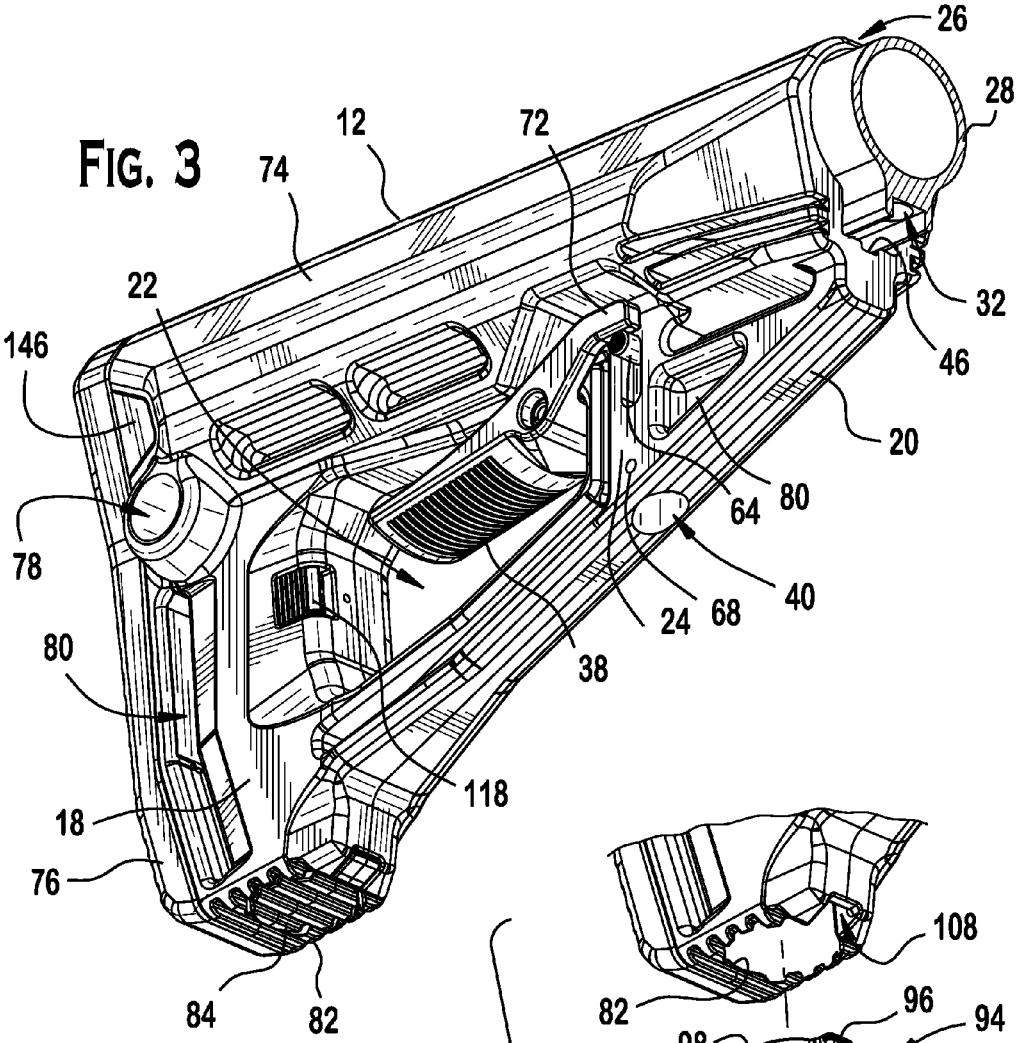
FIG. 3 is another perspective view of the stock of FIG. 1.

Referring to FIGS. 1-3, the illustrative stock 10 of the present invention may include an upper housing 12 having a distal end 14 and a proximal end 16, a rear housing 18 situated adjacent the proximal end, and a diagonal member 20 connecting a lower portion of the rear housing to the distal end of the upper housing. The upper housing, rear housing and diagonal member may define an opening 22 in the stock, which extends from one side of the stock to the other side of the stock. The stock may further include a web 24 disposed between the upper housing and a distal part of the diagonal member. As shown in FIG. 3, the proximal end 16 of the stock may include a receiver extension attachment site 26, which may be configured and dimensioned to receive a receiver extension 28. As shown in FIG. 1, the receiver extension may be a receiver extension for an M4 carbine (or AR-15 type weapon) 30.

Figure 7:
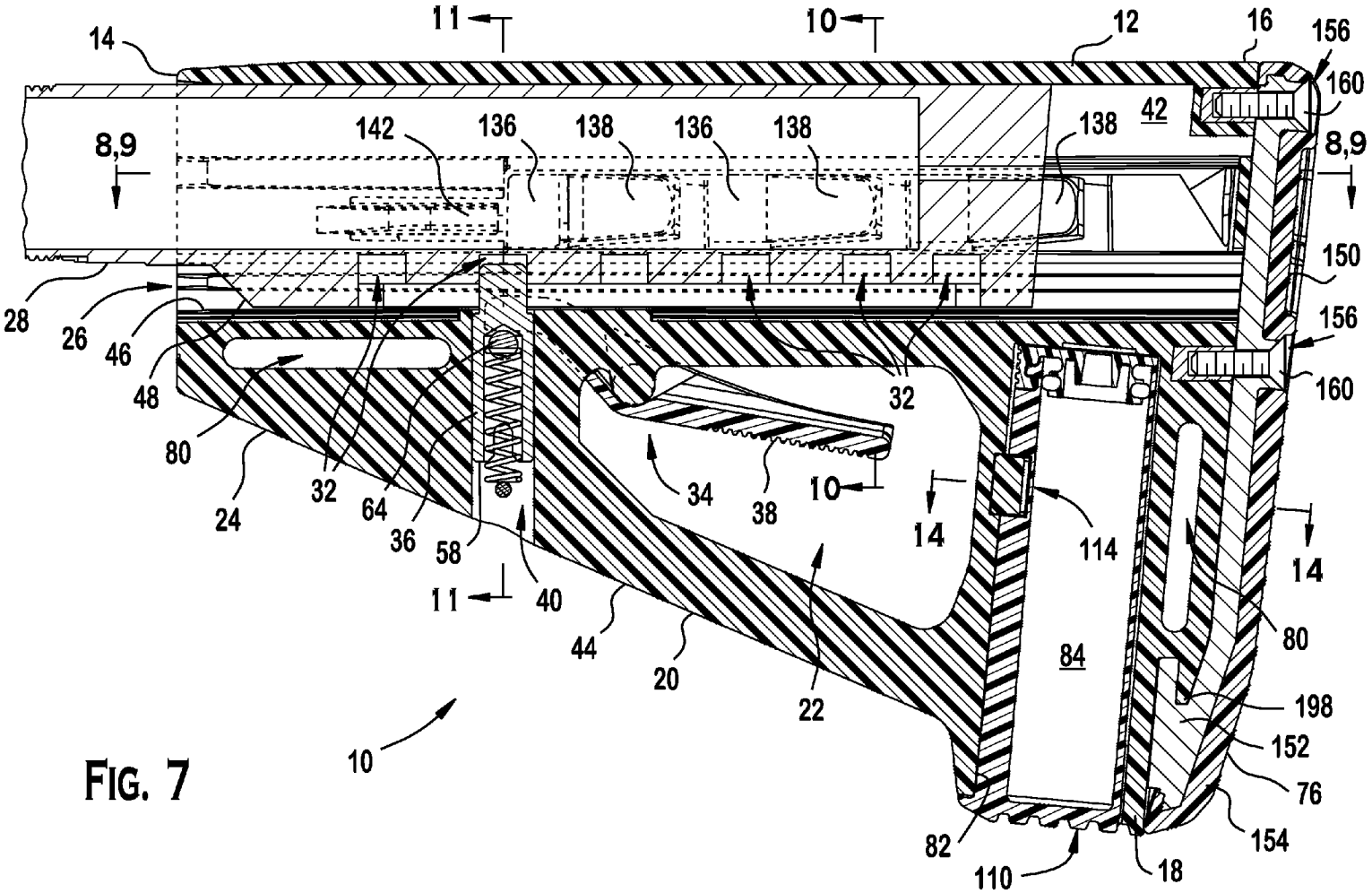
FIG. 7 is a cross-sectional view of the stock of FIG. 1, along line 7-7 of FIG. 2.

Referring to FIG. 7, the receiver extension may be telescopically received within the receiver extension attachment site and may include a number of locking pin holes 32 for selecting and fixing the position of the receiver extension 28 with respect to the stock 10.

The stock further may include a latch 34 for selectively withdrawing a spring loaded locking pin 36 from the receiver extension pin holes. A lever 38 for the latch 34 may be disposed in the opening 22 in the stock, and the spring loaded locking pin 36 may be disposed in a vertical bore 40 in the web 24.

In the illustrative embodiment, the vertical bore 40 may extend from inside the upper housing 42 through the web 24 to a bottom surface 44 of the diagonal member 20. The vertical bore 40 may define a side wall. One end of the side wall may open to a track 46 inside the upper housing, which may be configured and dimensioned for slidingly receiving a bottom rail 48 of the receiver extension 28. The other side of the vertical bore may open to the bottom surface 44 of the diagonal member.

Figure 11:
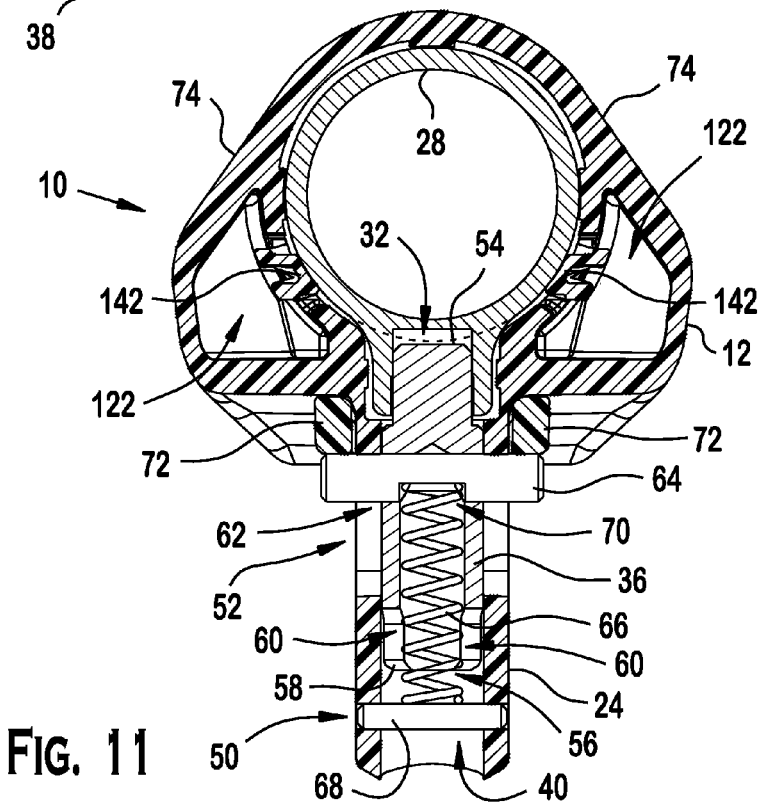
FIG. 11 is a cross-sectional view of the stock of FIG. 1, along line 11-11 of FIG. 7.
Figure 12:
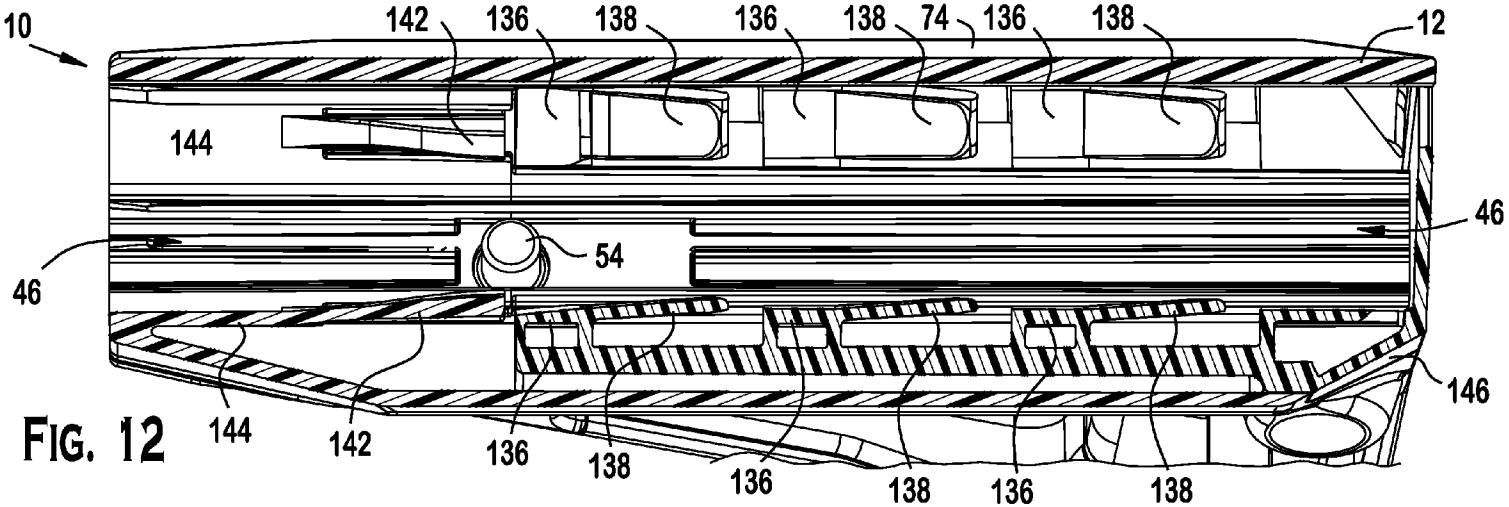
FIG. 12 is a cross-sectional view of the stock of FIG. 1, along line 12-12 of FIG. 10.
Figure 13:
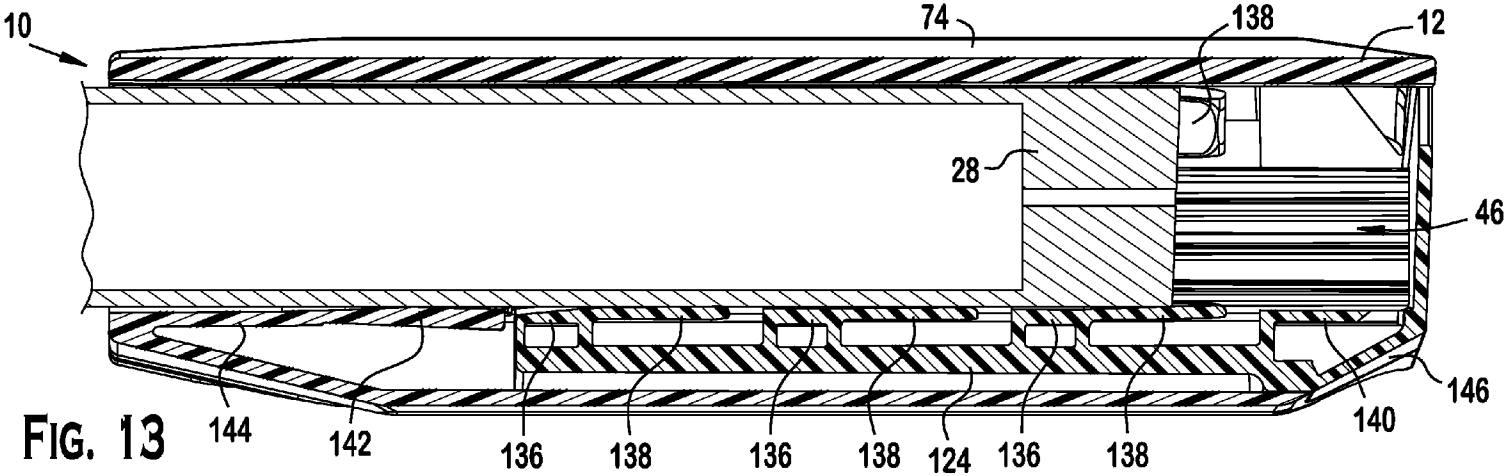
FIG. 13 is a cross-sectional view of the stock of FIG. 1, along line 13-13 of FIG. 10.

Referring to FIG. 11, the web 24 further may include first and second lateral passages 50, 52 that intersect the vertical bore 40. The first lateral passage 50 may be located near the other side of the vertical bore. The second lateral passage 52 may be located between the first lateral passage and the upper end of the vertical bore. The second lateral passage 52 may form a slot in the web. Moreover, the locking pin 36 may include a tip 54 on one end that is configured and dimensioned to securely engage the receiver extension locking pin holes 32. The locking pin 36 may include an internal bore 56 that extends from the opposite end of the locking pin 36 along the longitudinal axis of the pin toward the tip 54. The opposite end 58 of the locking pin 36 may include a pair of opposing slots. The locking pin 36 further may include a transverse bore 62 that extends through the locking pin 36. The transverse bore 62 may intersect the internal bore 56.

The spring loaded locking pin 36 further may include a cross pin 64, a coil spring 66, and a set pin 68. The cross pin 64 may include a side cavity 70. The tip 54 of the locking pin may be inserted into the vertical slot 40 and the cross pin 64 may be placed through the second lateral passage 52 in the web 24, as well as the transverse bore 62 of the locking pin. The coil spring 66 may be inserted into the internal bore 56 of the locking pin 36 such that one end of the coil spring is received in the cross pin side cavity 70. The coil spring may be fully seated by compressing the spring 66 and securing the other end with the set pin 68.

The latch 34 may be formed from the spring loaded locking pin 36 and the lever 38, which may be pinned to the upper housing 12. The lever 38 may include a pair of opposing projections 72, which rest on top of the cross pin 64. Pulling the lever 38 toward the upper housing 12 rotates the lever and pushes the cross pin 64 away from the housing 12 to retract the tip 54 of the locking pin 36. The coil spring 66 compresses under the force of the lever 38. After the lever is released, the coil spring expands and returns the locking pin 36 to the extended position.

Referring back to FIG. 1, the stock may be configured for modular attachment to an M4 or an AR-15 type firearm. The receiver extension attachment site may be configured and dimensioned, however, to connect with receiver extensions of other weapons.

Referring to FIG. 3, the stock further may include a cheek wield 74, a removable back plate 76, a swivel attachment site 78, openings 80 for a sling or a sling retention device, as well as a latched compartment 82. The latched compartment 82 may be disposed in the rear housing between the back plate and the latch. The latched compartment 82 may store a sealed capsule 84 that may be withdrawn from the bottom of the stock 10.

Figure 4:
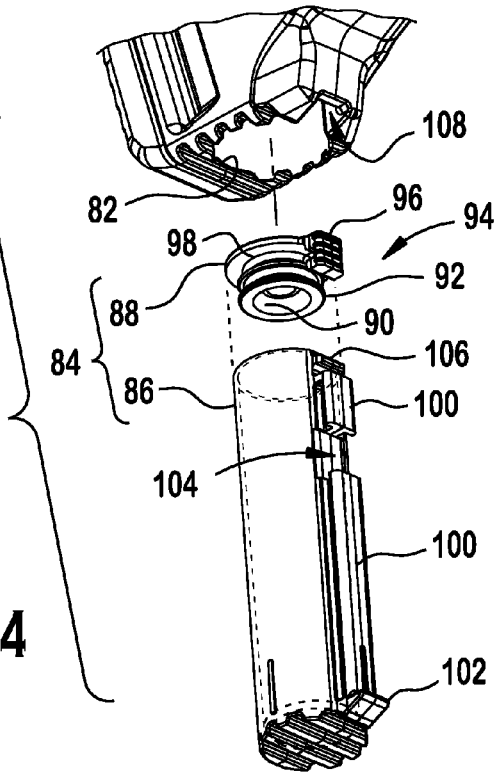
FIG. 4 is an exploded view of a lower portion of the stock, showing a storage capsule.

Referring to FIG. 4, the capsule 84 may include a cylindrical tube 86 and a cap 88. The cap may be configured in dimension to seal the top of the capsule. The cap may include an inner surface and a projection 90 that includes a plug 92. The plug may be received in the tubular member of the capsule. The plug may seal the interior region of the tubular capsule from the external environment. The plug may include an O-ring or similar resilient structure provided that the plug seals the interior of the capsule from the external environment. The cap 88 further may include a locking mechanism 94. The locking mechanism 94 may be a cantilevered block 96 on the cap of the capsule. The block may include a recess 98 facing the plug. The capsule 84 may include a rail 100 on an exterior surface. The rail 100 may extend parallel to the longitudinal access of the capsule. The rail may include a projection 102 at the base of the capsule. The rail 100 may include a void 104 toward the top of the capsule. Above the rail may be a minor projection 106. The minor projection 106 may be configured in dimension to mate with the recess 98 on the cantilevered block 96.

The cap 88 may be inserted into the top of the cylindrical tube 86 and rotated. Rotating the cap 88 may cause the minor projection 106 to be positioned inside the recess 98 on the block on the cap. In this configuration, the cap closes the tubular member, the plug seals the tubular member from the exterior environment, and the block and projection lock the cap to the capsule. The locked capsule may be inserted into the latched compartment 82 at the base of the stock. The latched compartment 82 may include a track 108 for receiving the rail 100 of the capsule.

Figure 14:
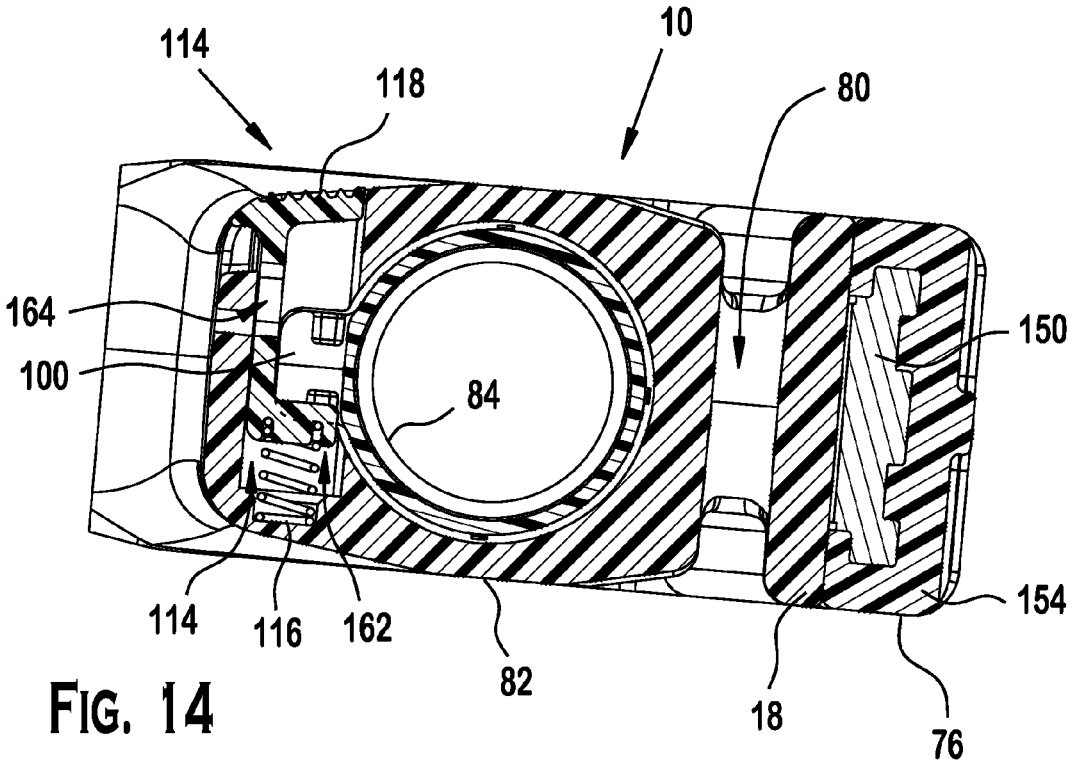
FIG. 14 is a cross-sectional view of the stock of FIG. 1, along line 17-17 of FIG. 7.

Referring to FIG. 7, the capsule 84 may be completely inserted into the latched compartment 82 in the stock, so that the bottom portion 110 of the capsule forms a portion of the bottom of the stock. The capsule may be retained within the latched compartment 82 by a catch 114. As shown in FIG. 14, catch 114 may be housed within a recess 116 in the stock. The recess 114 may further house a compression spring 116. The catch (or automatic latch) may include a keeper 118 that may be positioned within the void 104 in the rail 100 to block relative movement between the stock 10 and the capsule 84.

Figure 15:
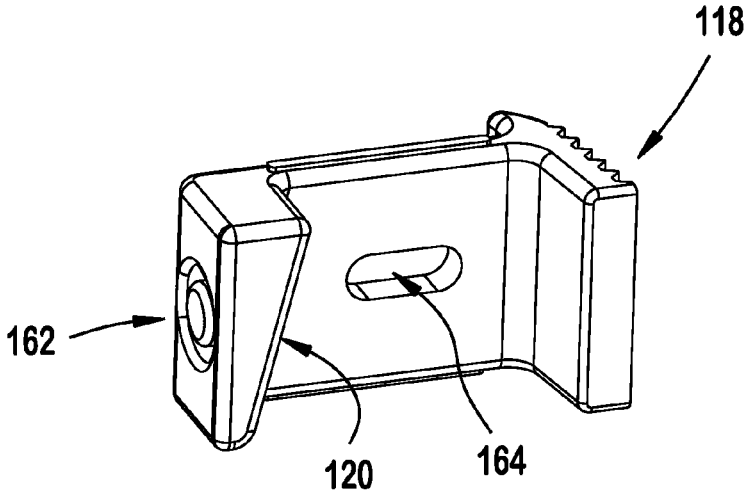
FIG. 15 is a perspective view of the catch of FIG. 7.

Referring to FIG. 15, the keeper 118 may be C-shaped and include an inclined internal surface 120. The keeper may include a coil spring connection structure attachment 164 and a retention pin slot 166. The inclined internal surface 120 may be positioned in the recess 114 of the stock such that the rail 100 of the capsule may progress upward through the keeper 118 and push the keeper inward until the missing portion 104 of the rail passes the inclined surface 120. At this point, the compression spring 116 may push the keeper 114 outward to lock the cartridge rail 100 in place. To release the capsule 82, the keeper 118 may be depressed such that the rail 100 is free to pass through the keeper 118, and the projection 102 on the base of the capsule may be pulled to withdraw the capsule from the latched compartment 82.

Figure 5:
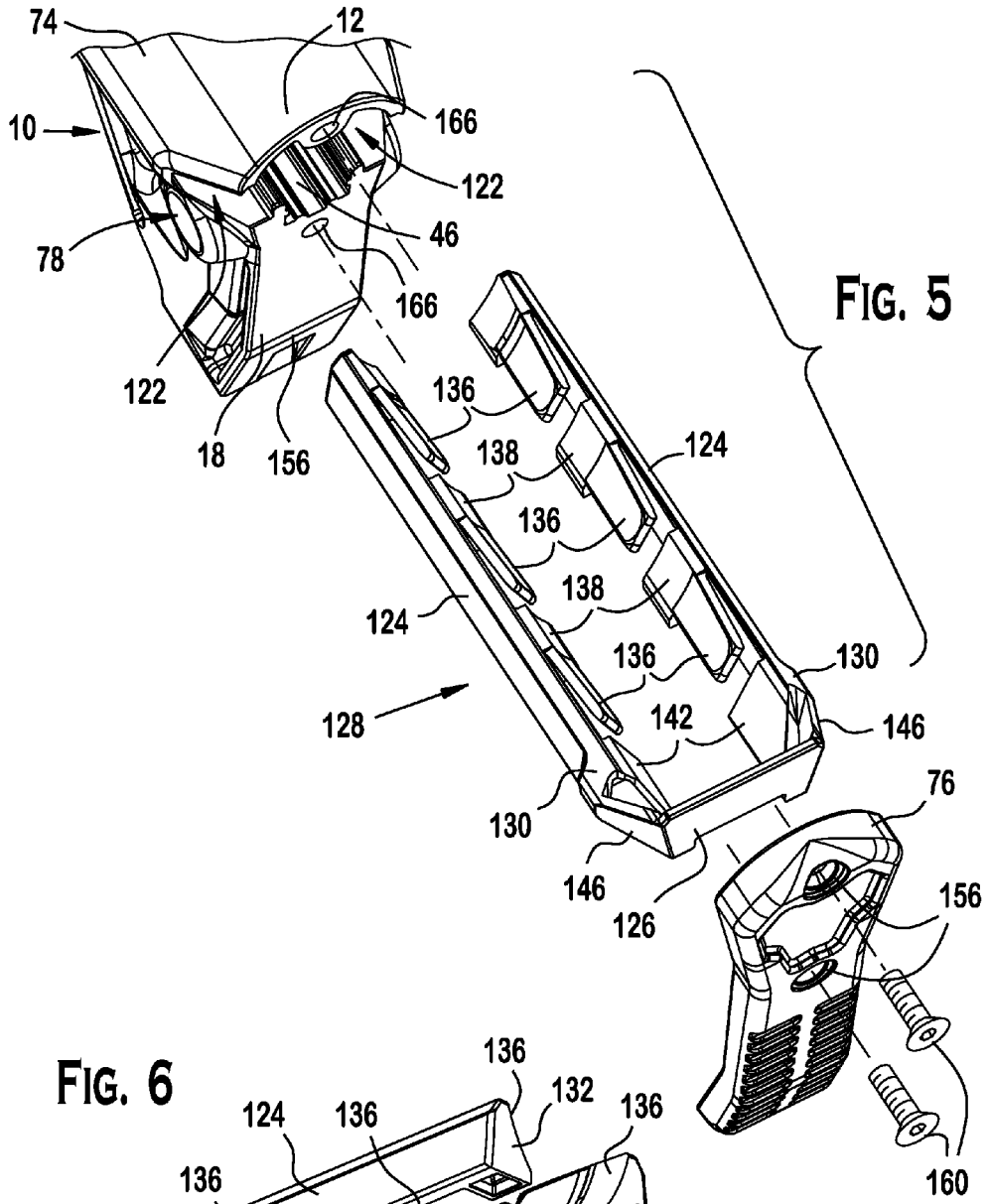
FIG. 5 is an exploded view of the rear portion of the stock, showing the anti-wobble insert and back plate of the stock of FIG. 1.
Figure 6:
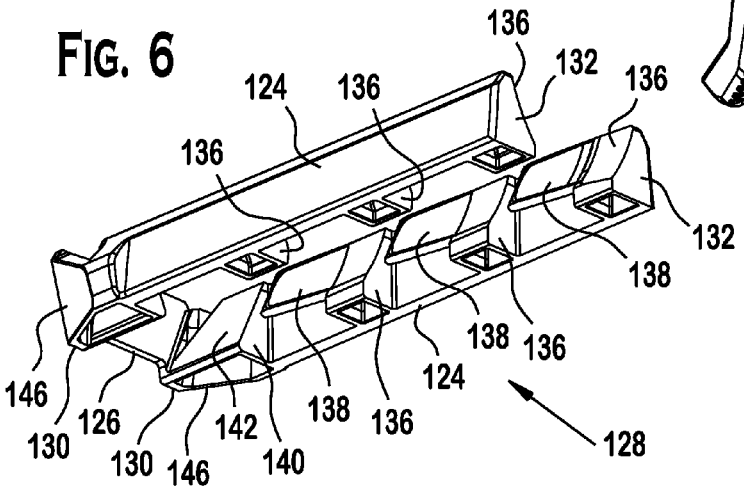
FIG. 6 is another perspective view of the anti-wobble insert.

Referring to FIG. 5, the upper housing 12 may include internal side chambers 122 on either side of the receiver extension track 46. Each chamber 122 may be configured and dimensioned to receive an insert 124 for isolating movement and damping vibration between the stock and an attached receiver extension. Each insert 124 may be separate from the other insert, or as shown in the illustrative embodiment, may be connected together; for example, by a bridge 126, to form an integral structure (or vibration isolator) 128. In the illustrative embodiment, the integral structure 128 is generally U-shaped. The upper housing 12 may include fastener holes 166 for securing the back plate 76 with fasteners 160. The fastener holes 166 and the fasteners 160 may include mating screw threads.

Figure 8:
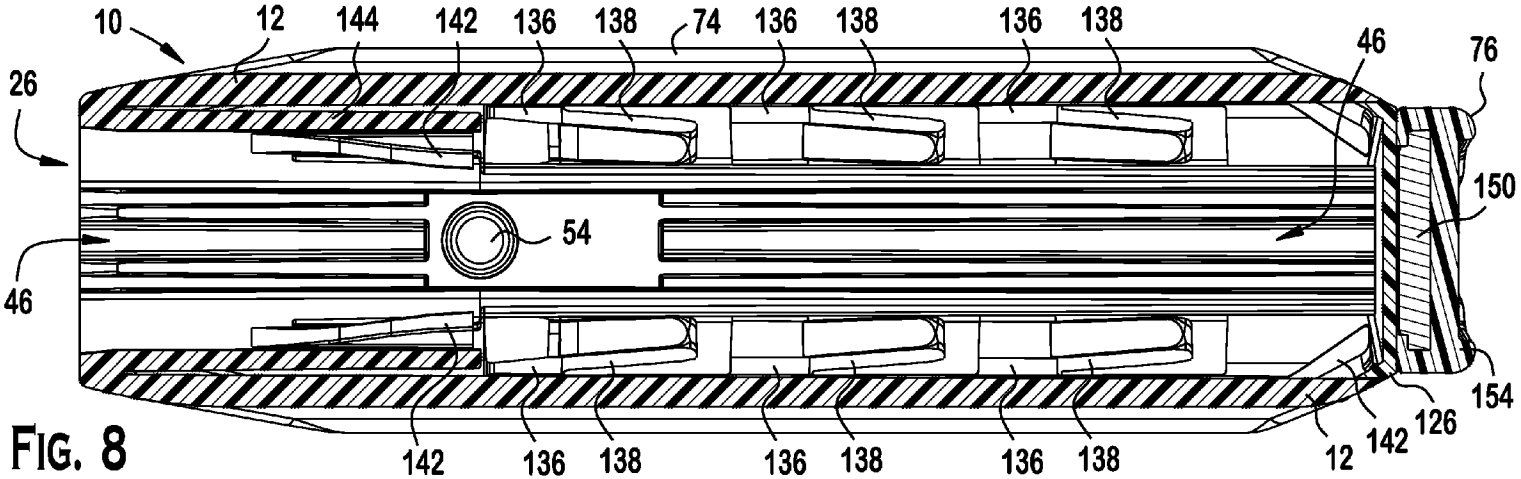
FIG. 8 is a cross-sectional view of the stock of FIG. 1, along line 8-8 of FIG. 7.

Referring to FIG. 8, each insert 124 may include a proximal end 130 that is located near the back plate 76 and a distal end 132 that extends into the side chamber 122 in the upper housing 12 of the stock. Each insert 124 may include one or more leaf springs (or leaf members) 134. Each leaf member 134 may include a support 136 and a resilient cantilever 138. The inserts may be positioned within the stock, such that the leaves protrude into the portion of the stock that accommodates the receiver extension 28. Each insert further may include one or more spacer(s) 140. The one or more spacer(s) 140 may have an angled face 142 that is configured and dimensioned to provide additional support to the receiver extension.

Figure 9:
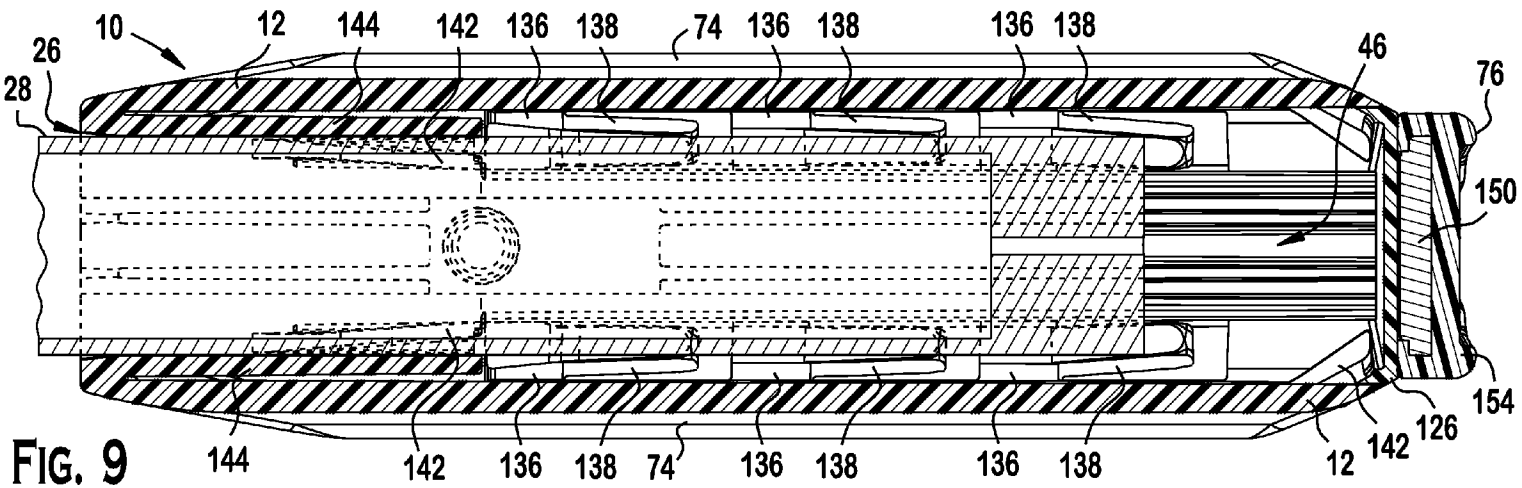
FIG. 9 is a cross-sectional view of the stock of FIG. 1, along line 9-9 of FIG. 7.
Figure 10:
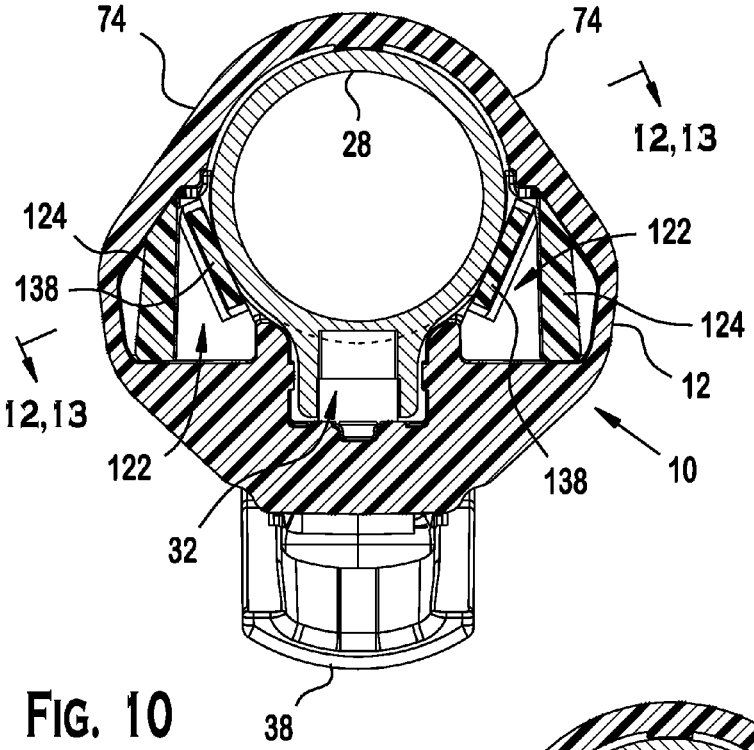
FIG. 10 is a cross-sectional view of the stock of FIG. 1, along line 10-10 of FIG. 7.

As shown in FIG. 9, one or more of the leaf members 134 may deform under pressure from the receiver extension 28 when connected to the receiver extension. The leaf member(s) 134 may push against the housing and receiver extension to provide a snug connection between the stock and receiver extension. In this manner, the inserts and one or more spacers 140 may prevent movement between the receiver extension and the stock, and isolate vibration and reduce noise in the assembly.

Additionally, referring to FIG. 8, the stock may include another pair of resilient fingers 142. The resilient fingers 142 may be part of the upper housing 12 internal sidewall 144. The resilient fingers may be located adjacent to the internal side chambers 122 which receive the insert(s) 124. The resilient fingers may be located on opposing sides of the receiver extension 28, such that the receiver extension may contact each resilient finger and displace each resilient finger outwardly to form another snug interface between the stock 10 and the receiver extension 28. The vibration isolator 128 as a whole or individual insert(s) 124 may be available as replacement parts.

Referring to FIG. 5 a portion 146 of the U-Shaped vibration isolator may form part of the exterior surface of the upper housing.

Referring to FIG. 7, the back plate 76 may have a rigid component 150 which includes a hook 152, a rubber coating 154, and fastener holes 156. The back plate 76 may be connected to the proximal end of the upper housing 12 and rear housing 18. For example, the hook 152 may be secured to a mating projection 158 near the rear housing 18 and the upper part of the back plate may be connected to the proximal end of the upper housing 12 with fasteners (e.g., screws) 160.

In a preferred embodiment the stock may be a fiber-reinforced polymer, such as nylon 6/6 with 30% glass, carbon or aramid fiber threads, but any strong and durable material may be used. Additionally, the U-shaped vibration isolator may be formed from the same material.

In use, the locking pin 36 of the stock 10 may be retracted with the lever 38, and the receiver extension 28 may be slid into the receiver extension attachment site 26. The receiver extension 28 may be advanced into the stock 10 until a set position (or locking pin hole) has been selected by the user. The lever 38 then may be released and the stock 10 manipulated until one locking pin hole 32 in the bottom of the receiver extension 28 interlocks with the locking pin 36. The resilient fingers 142 and leaf members 134 of the inserts 124 may be compressed by the receiver extension 28 to form a snug connection between the stock 10 and the receiver extension 28 for isolating movement and damping vibration of the assembly.

While it has been illustrated and described what at present are considered to be preferred embodiments of the present invention, it will be understood by those skilled in the art that various changes and modifications may be made, and equivalents may be substituted for elements thereof without departing from the true scope of the invention. Accordingly, it is intended that this invention not be limited to the particular embodiments disclosed herein, but that the invention include all embodiments falling within the scope of the appended claims.

What is claimed is:

1. A stock for a small arms weapon comprising:

a first member having a longitudinal axis which comprises
- a proximal end surface,
- a distal end surface which comprises a first opening extending toward the proximal end surface,
- a multi-lobe chamber connected to the first opening which comprises
  - a primary lobe for housing a receiver extension which comprises
    - a track for supporting a bottom surface of a receiver extension,
    - a first wall for supporting a first side surface of a receiver extension, and
    - a second wall for supporting a second side surface of a receiver extension,
  - a first side lobe adjacent to the first wall, and
  - a second side lobe adjacent to the second wall;

a first insert disposed in the first side lobe for isolating movement between the first side of the stock and a receiver extension disposed in the track which comprises
- a first side leaf member which comprises
  - a first side base, and
  - a first side resilient cantilever extending from the base such that the first side resilient cantilever deforms under pressure applied by a receiver extension disposed in the track opposite the first side leaf member to isolate movement between the first side of the stock and the receiver extension;

a second insert disposed in the second side lobe for isolating movement between the second side of the stock and a receiver extension disposed in the track.

2. The stock of claim 1, wherein the first insert comprises three first side leaf members.

3. The stock of claim 2, wherein the second insert comprises
- a second side leaf member which comprises
  - a second side base, and
  - a second side resilient cantilever extending from the second side base such that the second side resilient cantilever deforms under pressure applied by a receiver extension disposed in the track opposite the second side leaf member to isolate movement between the second side of the stock and the receiver extension.

4. The stock of claim 1, further comprising a connecting member joining the first insert and the second insert to form a integral shim and damper in the multi-lobe chamber such that the integral shim and damper supports a receiver extension disposed in the track and prevents and isolates movement between the stock and a receiver extension connected to the stock.

5. The stock of claim 4, wherein the first member further comprises an exterior surface and a portion of the connecting member forms a part of the exterior surface.

6. The stock of claim 1, wherein the proximal end surface further comprises a fastener attachment site.

7. The stock of claim 6, further comprising a back plate secured to the proximal end surface.

8. The stock of claim 7, wherein the proximal end surface comprises a second opening connected to the multi-lobe chamber.

9. The stock of claim 8, wherein the back plate covers the second opening.

10. The stock of claim 1, further comprising a
- a second member connected to the first member which comprises
  - a third end adjacent to the proximal end, and
  - a fourth end spaced from the distal end.

11. The stock of claim 10, wherein the second member further comprises an interior compartment that is configured and dimensioned to house a cylindrical capsule.

12. The stock of claim 11, wherein the cylindrical capsule comprises a tubular member and a cap.

13. The stock of claim 12, wherein the cap further comprises a plug for sealing the tubular member.

14. The stock of claim 13, wherein the cap further comprises a cantilevered block and the tubular member further comprises a projection such that the cap may be rotated with respect to the tubular member to interlock the projection and the cantilevered block.

15. The stock of claim 14, wherein the capsule further comprises a rail and the interior compartment further comprises a channel and a catch in the channel such that the rail of the capsule and the catch cooperate to lock the capsule in the interior compartment.

16. The stock of claim 10, further comprising:
- a third member connected to the first and second members which comprises,
  - a fifth end connected to the distal end of the first member, and
  - a sixth end connected to the fourth end of the second member.

17. The stock of claim 16, further comprising a web disposed between the first member and the third member.

18. The stock of claim 17, further comprising a spring loaded locking pin disposed in the web such that the locking pin is configured and dimensioned to interlock with a receiver extension disposed in the track to fix the stock to the receiver extension.

19. A method for assembling a small arms weapon stock having a vibration isolator comprising:

providing a stock for a small arms weapon which comprises,
- a first member having a longitudinal axis which comprises
  - a proximal end surface,
  - a distal end surface which comprises a first opening extending toward the proximal end surface, and
  - a multi-lobe chamber connected to the first opening which comprises
    - a primary lobe for housing a receiver extension which comprises
      - a track for supporting a bottom surface of a receiver extension,
      - a first wall for supporting a first side surface of a receiver extension, and
      - a second wall for supporting a second side surface of a receiver extension,
    - a first side lobe adjacent to the first wall, and
    - a second side lobe adjacent to the second wall;

passing a vibration isolator into the first side lobe and the second side lobe from the proximal end of the stock for supporting a receiver extension disposed in the track and isolating movement between the stock and a receiver extension disposed in the track; and securing a back plate to the proximal end surface to enclose the vibration isolator in the stock.

* * * * *